United States Patent [19]

Zang

[11] Patent Number: 4,890,419

[45] Date of Patent: Jan. 2, 1990

[54] DEVICE FOR GRINDING CUTTING TOOLS HAVING STRAIGHT AND SPIRAL GROOVES

[76] Inventor: Volker Zang, Westerheimer Strasse 30, Post Laichingen 4, D-7903 Feldstetten, Fed. Rep. of Germany

[21] Appl. No.: 161,158

[22] Filed: Feb. 6, 1988

[30] Foreign Application Priority Data

Mar. 4, 1987 [DE] Fed. Rep. of Germany ..... 3706948

[51] Int. Cl.[4] ..... B24B 47/02

[52] U.S. Cl. ..... 51/95 LH; 51/218 R

[58] Field of Search ..... 51/218 R, 95 TG, 215 SF, 51/218 A, 218 T, 219 R, 165.77, 215, 79, 95 LH

[56] References Cited

U.S. PATENT DOCUMENTS

| | | | |
|---|---|---|---|
| 1,355,616 | 10/1920 | Mohn | 51/236 |
| 2,325,364 | 7/1943 | Boening | 51/219 PC |
| 2,503,926 | 4/1945 | Tobias | 51/95 TG |
| 3,600,860 | 8/1971 | Liepold | 51/95 LH |
| 4,703,588 | 11/1987 | Hosoi | 51/219 PC |

*Primary Examiner*—Frederick R. Schmidt

*Assistant Examiner*—Jack Lavinder

*Attorney, Agent, or Firm*—Toren, McGeady & Associates

[57] ABSTRACT

A device for grinding cutting tools having straight and spiral grooves includes a workpiece or tool spindle which is rotatable in a housing and can be set in a combined turning and advancing motion. A roller capable of engaging the outer surface of the spindle with a certain definable contact pressure is rotatable and adjustable about an axis which extends in radial direction relative to the spindle. The device further includes a locking unit for fixing the angular position of the spindle. The roller is mounted so as to be movable back and forth in the direction of the adjusting axis by means of a first actuating unit. The roller is held in frictional contact engagement with a spindle against the force of springs. The locking unit is movable by means of a second actuating unit from the first position in which it releases the spindle into a second position in which it locks the spindle. The first actuating unit is releaseable in dependence upon the position of axial advancement of the spindle.

9 Claims, 2 Drawing Sheets

DEVICE FOR GRINDING CUTTING TOOLS HAVING STRAIGHT AND SPIRAL GROOVES

BACKGROUND OF THE INVENTION

1. Field of the Invention

The present invention relates to a device for grinding cutting tools having straight and spiral grooves. The device includes a workpiece or tool spindle which is rotatable in a housing and can be set in a combined turning and advancing motion. A roller capable of engaging the outer surface of the spindle with a certain definable contact pressure is rotatable and adjustable about an axis which extends in radial direction relative to the spindle. The device further includes a locking unit for fixing the angular position of the spindle.

2. Description of the Prior Art

Devices of the above-described type are used in connection with conventional tool grinding machines. Such a device includes a spindle which is mounted so as to be capable of rotating and reciprocating without play for receiving the tool to be ground. The pitch of the spindle necessary for generating the advance of the tool during grinding is adjustable by changing the setting angle of the roller which is in frictional engagement with the spindle. A device of this type is disclosed, for example, in German patent No. 32 32 689.

If a tool having several spirally extending cutting edges, for example, a plain milling cutter is to be ground, it is necessary after the first tool cutting edge has been ground to turn the spindle for grinding the other tool cutting edges by a certain angle from its angular position for the first tool cutting edge which corresponds to a zero plane intersecting the longitudinal axis of the spindle. Compare, for example, U.S. Pat. No. 2,503,926. For this purpose, it is necessary to separate the frictional engagement between spindle and roller and to move the spindle into the new angular position by means of the locking unit which acts as an indexing unit. In the new angular position, the spindle is again radially and axially fixed by means of the locking unit. For the subsequent grinding of the new tool cutting edge, the roller is placed on the spindle and is separated after the locking unit has been mounted. This is done by means of separate manipulating devices which are structurally compensated and require time-consuming adjusting operations which are also time-consuming.

It is, therefore, the primary object of the present invention to provide a device of the above-described type which is simple with respect to construction and operation. Specifically, a device is to be provided which, while still being free of play, makes it possible to carry out more quickly and safely than in the past to adjust the spindle in accordance with the graduation of the cutting edges of the tool to be ground. In addition, operating errors are to be made virtually impossible.

SUMMARY OF THE INVENTION

In accordance with the present invention, the roller of the device for grinding cutting tools having straight and spiral grooves is mounted so as to be movable back and forth in the direction of its adjusting axis by means of a first actuating unit. In addition, the roller is held in frictional contact engagement with the spindle against the force of springs. The locking unit is movable by means of a second actuating unit from a first position in which it releases the spindle into a second position in which it locks the spindle. The first actuating unit is releaseable in dependence upon the axial position of advancement of the spindle.

The device according to the present invention has many advantages.

Because of a normally closed contact which is moved into the open position in the initial grinding position of the spindle, the first actuating unit is without current, so that the roller which determines the pitch of the spindle is automatically lifted from the spindle. Thus, the adjustment of the released spindle to the new angular position becomes simpler and damage to the surfaces of spindle and roller during adjustment is prevented and, consequently, the operating accuracy is improved.

For carrying out an indexing operation, the second actuating unit is to be closed by means of an operating contact or normally open contact in the form of an impulse switch, so that an indexing pin of the locking unit is moved into its operating position. When a new angular position determined by a graduated disk mounted on the spindle is reached, the indexing pin engages the graduated disk and moves the graduated disk by means of a centering bore provided on the circumference of the graduated disk and, thus, the spindle connected to the graduated disk is moved in axial direction into the locked position, whereby the normally closed contact of the first actuating unit which had been opened until then is closed. Consequently, the first actuating unit is again switched on and moves the roller into contact with the spindle. The impulses which cannot be released, so that the second actuating unit becomes without current and the indexing pin again assumes its position of rest. The spindle cannot be moved for another grinding procedure.

Accordingly, the adjustment of the spindle is substantially simplified and requires little effort.

Another advantage is that the contact pressure between roller and spindle can be controlled in a simple manner.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE INVENTION

Figure 1:
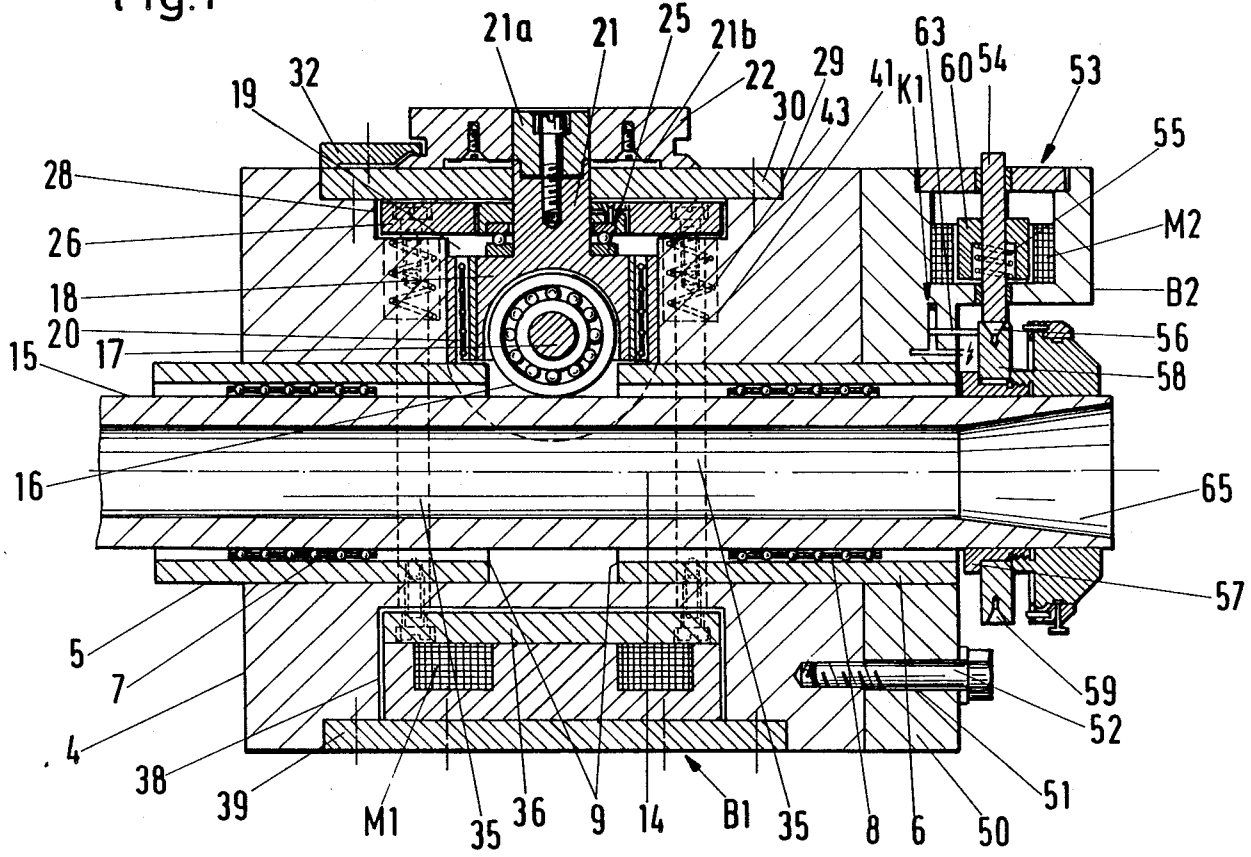
FIG. 1 is sectional view of a device for the grinding of cutting tools having straight and spiral grooves in accordance with the present invention.

As illustrated in FIG. 1 of the drawing, a two-piece guide bushing 5 and 6 is mounted in a housing 4. A spindle 14 receiving a workpiece or tool is mounted so as to be axially movable and rotatable in guide bushings 5 and 6 through ball cages 7 and 8. The outer surface 15 of spindle 14 engages in the position illustrated in FIG. 1 a roller 16 which is rotatably mounted in a bearing fork 18 through a bearing bolt 17. Bearing fork 18 is mounted so as to be movable upwardly and downwardly in housing 4 through a ball bearing 20. For this purpose, a free space 9 is provided between the two guide bushings 5 and 6 facing each other.

Bearing fork 18 is arranged in a recess 19 in housing 4 and has a cylindrical projection 21 which is rigidly connected in radial direction with an adjusting disk 22 which rests on housing 4. The adjusting disk 22 fixed by means of locking member 32 is connected through a pressure piece 21*a* and a spring plate disk 21*b* to the cylindrical projection 21 of the bearing fork 18 in such a way that an axial movement for lifting the roller 16 from the outer surface 15 of the spindle 14 is possible without changing the adjusted spiral angle.

A thrust bearing 25 is provided at the cylindrical projection 21. A pressure plate 26 acting as a switching member acts on the thrust bearing 25. The pressure plate 26 is arranged in another recess 28 of housing 4. Recess 28 is wider than recess 19. Another recess 29 which, in turn, is wider than recess 28 and is located adjacent recess 28, receives a closure plate 30 on which the locking member 32 is adjustably mounted. Thus, the recesses 19, 28 and 29 form a step-like recess in housing 4 which extends to the guide bushings 5 and 6.

Connected to the pressure plate 26 are four spaced-apart spacer bolts 35 which are arranged outside of the area of the guide bushings 5 and 6 and extend through bores in the housing 4. The opposite ends of the spacer bolts 35 are screwed into an anchor plate 36. This anchor plate 36 forms part of a first actuating unit $B_1$ and is arranged adjacent to an electromagnet $M_1$. The actuating unit $B_1$ is arranged in a recess 38 of housing 4 and is closed off toward the outside by means of a cover plate 39 which extends flush with the housing.

Springs 43 are arranged coaxially with the spacer bolts 35 in blind-end bores 41. As seen in FIG. 1, pressure plate 26 is biased upwardly by the springs 43 to the extent of a gap of about 2 mm provided for this purpose. In the unexcited state of the electromagnet $M_1$ of actuating unit $B_1$, the pressure plate 26 is lifted from the bearing fork 18 and, thus, no contact pressure exists between roller 16 and the outer surface of spindle 14. In the excited state of the electromagnet $M_1$ of the actuating unit $B_1$, the roller 16 is adjusted to the required spiral angle of the workpiece after the locking member 32 has been released. The adjusted position can ten be fixed by means of the locking member 32.

The necessary spiral angle of the workpiece can be taken from tables. The pitch of the workpiece in millimeters per rotation corresponds to a certain adjustment angle of the adjusting disk 22. However, the necessary angular position of the adjusting disk 22 for an existing spiral inclination at the workpiece can also be adjusted directly by means of a dial gauge. When the electromagnet $M_1$ of actuating unit $B_1$ is excited, the anchor plate 36 and the spacer bolts 35 move the anchor plate 26 against the thrust bearing 25 and, thus, against the bearing fork 18, so that the roller 16 is pressed against the outer surface 15 of spindle 14 with a pressure which corresponds to the holding force of the electromagnet.

At the end face of the housing 4 on the righthand side as seen in FIG. 1, a bearing plate 50 is rotatably mounted coaxially relative to spindle 14. Bearing plate 50 is lockable in the respective adjusted position by means of a setscrew 52 which engages a semicircular slot 51. A locking device 53 for the spindle 14 is fixedly connected to the bearing plate. The locking or indexing device 53 includes an indexing pin 54 which is mounted so as to be movable upwardly and downwardly in radial direction relative to spindle 14. Indexing pin 54 is held in its position of rest by means of a spring 55. In the position of rest, the conical tip 56 of indexing pin 54 is disengaged from an indexing disk 58 which is fixedly connected to spindle 14. Indexing disk 58 has truncated cone-shaped recesses 59 arranged uniformly distributed over the circumference thereof.

The locking device 53 further includes an actuating unit $B_2$ which also has an electromagnet $M_2$ which, when excited, moves the indexing pin 54 through a switching member 60 against the force of spring 55 into the operating position illustrated in FIG. 1 in which the tip 56 of indexing pin 54 engages in one of the recesses 59 and locks the spindle 14 against rotation and axial movements, as illustrated in FIG. 1. The resulting position is the so-called initial grinding position in which a bearing flange 57 of spindle 14 on which the indexing disk 58 is arranged has a predetermined distance from the end face of the bearing plate 50. In the present embodiment, this distance is about 2 mm. From the position illustrated in FIG. 1, the spindle 14 can be moved in axial direction toward the right by approximately 128 mm, so that the entire axial freedom of movement of the spindle 14 in housing 4 is 130 mm.

Figure 2:
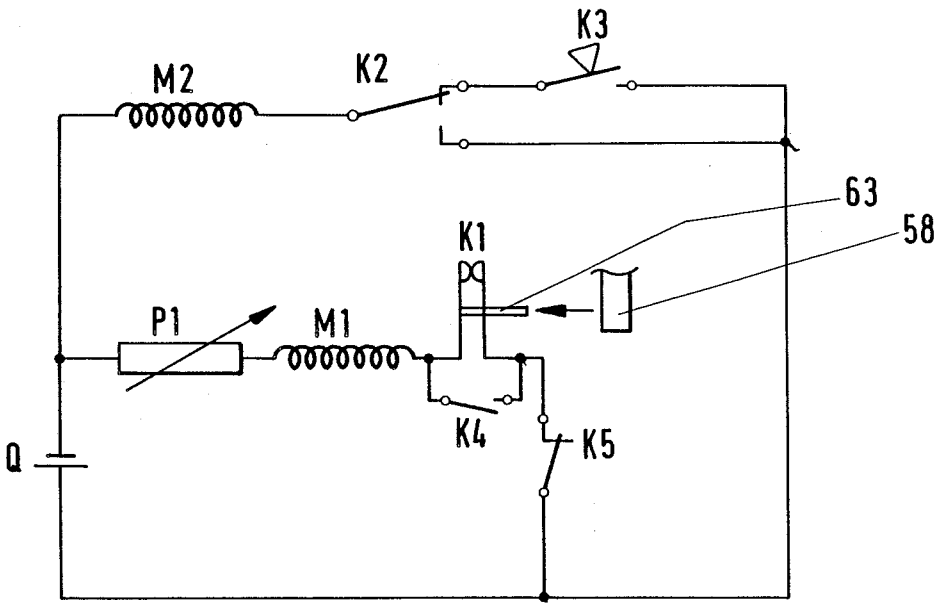
FIG. 2 is a circuit diagram of the actuating unit of the device of FIG. 1.

Bearing plate 50 further includes a normally closed contact $K_1$ which can be opened by means of an actuating pin 63 when the spindle 14 in its extreme position to the far left as seen in FIG. 2 in which the actuating pin 63 of the normally closed contact $K_1$ is opened by the indexing disk 58.

The normally closed contact $K_1$ is part of a circuit illustrated in FIG. 1 which includes a current source Q, a potentiometer $P_1$, and exciting coil $M_1$ of actuating unit $B_1$, a coil $M_2$ of the actuating unit $B_2$ and additional friction contacts $K_2$, $K_3$, $K_4$ and $K_5$.

As can be seen in FIG. 2, switching contact $K_2$ is a change-over switch which is connected in series in the first switching position with switching contact $K_3$. Switching contact $K_3$ is an impulse switch which is held in the open position by means of a spring. In the second switching position of change-over switch $K_2$, not shown in FIG. 2, the impulse switch $K_3$ is bypassed.

Normally closed contact $K_1$ which is connected in series to switching contact $K_5$ can be bypassed by means of switching contact $K_4$. Thus, the function of the normally closed contact $K_1$ can be bypassed by means of switching contacts $K_4$ and $K_5$. Potentiometer $P_1$ is used to adjust the magnitude of the exciting current of magnet $M_1$ of actuating unit $B_1$ and, thus, the contact pressure of the roller 16 against the outer surface 15 of spindle 14.

The operation of the above-described device is as follows.

The setting angle of the roller 16 and, thus, the spiral pitch of spindle 14 are to be adjusted by means of adjusting disk 22 in accordance with the spiral angle of the cutting edges of the tool to be ground, not shown in FIG. 1, which is to be inserted into the conical portion 65 of the spindle. The spiral angel of the tool is only identical when the shaft and workpiece have the same diameter. For adjusting the spiral angle by means of adjusting disk 22, the locking member 32 must be rendered inoperative, while, after the angle has been adjusted, the locking member 32 is again moved into a position in which it locks the adjusting disk 22. The spiral angle is adjusted with the actuating unit $B_1$ switched on.

In order to move the cutting edges of the workpiece into a new angular position relative to the grinding wheel by means of indexing disk 58, the spindle 14 must be moved from the initial grinding position illustrated in FIG. 1 towards the left until the stop of the bearing flange 57 at the end face of the guide bushing 6 is reached, so that the normally gross contact $K_1$ is opened by the indexing disk 58 and the actuating disk 63. By moving the normally closed contact into the opened position, the first actuating unit $B_1$ is without current, so that the roller determining the pitch of the spindle is lifted from the spindle by means of springs 43. As a result, the spindle is released for adjusting the new angular position and, simultaneously, damage to the surface of spindle and roller is prevented.

Accordingly, for carrying out the indexing operation, after the adjustment of the spindle in accordance with the graduation of the tool to be ground into a new angular position, the second actuating unit $B_2$ is closed by means of the normally open contact $K_3$ which is an impulse switch, so that the indexing pin 54 of the locking unit is moved into its operating position against the force of spring 55.

After reaching the new angular position determined by the graduated disk mounted on the spindle, the indexing pin engages the selected recess 59 provided on the circumference of the graduated disk and, thus, due to the centering bore provided on the circumference of the graduated disk, moves the graduated disk and the spindle 14 connected therewith in axial direction into the locked position, i.e., the initial grinding position illustrated in FIG. 1, so that the previously open normally closed contact of the first actuating unit is again closed. As a result, the actuating unit $B_1$ is again switched on and the roller is moved by mean of the above-described switching members until the roller reaches contact with the spindle.

The impulse_switch can now again be released, so that the second actuating unit $B_2$ is without current and the indexing pin 54 again assumes it position of rest by means of spring 55. The spindle 14 can now be once again moved in axial direction of another grinding procedure and, simultaneously, the lowered roller 16 imparts a rotary motion to spindle 14 in accordance with the adjusted angle of inclination of roller 16. Thus, the spindle can be adjusted in a simple manner without requiring additional manipulations and in a manner which is not tiresome.

The contact pressure between roller and spindle can be controlled in a simple manner by adjusting the potentiometer $P_1$.

While a specific embodiment of the invention has been shown and described in detail to illustrate the application of the inventive principles, it will be understood that the invention may be embodied otherwise without departing from such principles.

I claim:

1. In a device for grinding cutting tools having straight and spiral grooves, including a housing, a workpiece or tool spindle having an axis and an outer surface, the spindle being rotatable and longitudinally movably mounted in the housing such that the spindle can be set in a combined turning and advancing motion, a roller defining an adjusting axis, the roller capable of engaging the outer surface of the spindle with a certain definable contact pressure, the roller being rotatable and being adjustable about an axis which extends in radial direction relative to the spindle, and an indexing means for fixing the angular position of the spindle, the improvement comprising the roller being mounted so as to be movable back and forth in the direction of the adjusting axis by means of a first actuating unit, the roller being held in frictional contact engagement with the spindle against the force of spring means, the indexing means being movable by means of a second actuating unit from a first position in which it releases the spindle into a second position in which it locks the spindle, the locking unit being spring-biased in the first position thereof, the indexing means including means for releasing the first actuating unit in dependence upon the second position of said indexing means.

2. The device according to claim 1, wherein the first actuating unit includes a first electromagnet which maintains the roller in an operating position through a first switching means which is held in a position of rest by means of at least one spring, and wherein the second actuating unit includes a second electromagnet which maintains an indexing pin in an operating position through a second switching means which is held in a position of rest by means of at least one spring.

3. The device according to claim 2, comprising a normally closed contact for supplying current to the first actuating unit, wherein the normally closed contact can be opened by axially moving the spindle into an initial grinding position, and wherein, after closing a first normally open contact, the second actuating unit can be switched on through a second normally open contact, the first normally open contact connected for bypassing the second normally open contact.

4. The device according to claim 3, wherein the second normally open contact is an impulse contact.

5. The device according to claim 3, comprising a third normally open contact for bypassing the normally closed contact when the normally closed contact is open, wherein the normally closed contact can be switched on and off by means of a fourth normally open contact which is connected in series.

6. The device according to claim 3, wherein, the spindle is movable by engagement of the indexing pin of the second actuating unit with the indexing disk into the initial grinding position in which the normally closed contact is closed.

7. The device according to claim 2, wherein the first actuating unit has an adjustable holding force.

8. The device according to claim 2, comprising a fork member which is mounted in the housing so as to be rotatable and upwardly and downwardly movable, the roller being rotatably mounted in the fork member, wherein the first switching means is a pressure plate, the pressure plate holding the roller in contact with the outer surface of the spindle under the influence of the first actuating unit.

9. The device according to claim 1, wherein the indexing means includes an indexing disk mounted on the spindle and an indexing pin interacting with the indexing disk, the indexing pin being disengaged from the indexing disk by means of a spring.

* * * * *